US011724905B2

(12) United States Patent
Chang

(10) Patent No.: US 11,724,905 B2
(45) Date of Patent: Aug. 15, 2023

(54) PRINTER WITH IMPROVED PAPER DISPENSING MECHANISM

(71) Applicant: INTERNATIONAL CURRENCY TECHNOLOGIES CORPORATION, Taipei (TW)

(72) Inventor: Chia-Min Chang, Taipei (TW)

(73) Assignee: INTERNATIONAL CURRENCY TECHNOLOGIES CORPORATION, Taipei (TW)

( * ) Notice: Subject to any disclaimer, the term of this patent is extended or adjusted under 35 U.S.C. 154(b) by 617 days.

(21) Appl. No.: 16/696,474

(22) Filed: Nov. 26, 2019

(65) Prior Publication Data

US 2021/0155441 A1 May 27, 2021

(51) Int. Cl.
*B65H 35/00* (2006.01)
*B65H 16/00* (2006.01)

(52) U.S. Cl.
CPC ..... *B65H 35/008* (2013.01); *B65H 16/005* (2013.01)

(58) Field of Classification Search
CPC .... B65H 35/008; B65H 16/005; B65H 16/06; B65H 2801/12; B65H 2801/00; B65H 2511/14; B65H 2511/17; B65H 230/4418; B65H 2404/1451; B41J 11/0095; B41J 11/70; B41J 13/0036; B41J 15/005; B41J 13/076; B41J 13/03; B41J 15/042
USPC ..... 83/81, 112, 167; 400/581, 621; 493/357, 493/416; 226/14, 111
See application file for complete search history.

(56) References Cited

U.S. PATENT DOCUMENTS 3,593,659 A * 7/1971 Brackett ..... B41F 7/24 101/247
5,993,093 A * 11/1999 Schoennauer ..... B41J 11/70 400/621
2005/0226671 A1* 10/2005 Harris ..... B41J 11/70 400/621
2011/0314981 A1* 12/2011 Furuta ..... B41J 11/70 83/167
2012/0010061 A1* 1/2012 Sekino ..... B41J 11/70 493/357
2016/0059589 A1* 3/2016 Murata ..... B41J 25/312 347/220
2016/0159115 A1* 6/2016 Awanohara ..... B41J 15/04 347/104

(Continued)

*Primary Examiner* — Ghassem Alie
(74) *Attorney, Agent, or Firm* — Muncy, Geissler, Olds & Lowe, P.C.

(57) ABSTRACT

A printer includes housing having reel mounted therein to support paper roll and paper exit formed in front panel thereof, printing mechanism positioned in the housing and printing head for printing an ink on the sheet of paper, paper cutter for cutting the sheet of paper and paper path defined between the printing head and the paper cutter for the passing of the leading end of the sheet of paper, and paper dispensing mechanism positioned in the housing, which includes drive module and paper dispensing roller set drivable by the drive module to carry the sheet of paper toward the paper exit. The paper dispensing roller set has two rollers made of a flexible and elastic material and pressed against each other. The distance between the center of the two rollers is less than the combination of the radius of the two rollers.

5 Claims, 4 Drawing Sheets

(56) References Cited

U.S. PATENT DOCUMENTS

| | | | | |
|---|---|---|---|---|
| 2016/0185139 | A1* | 6/2016 | Ishida | B26D 5/08<br>83/563 |
| 2020/0307262 | A1* | 10/2020 | Kosuge | B41J 2/325 |
| 2020/0307267 | A1* | 10/2020 | Nagase | B41J 11/68 |

* cited by examiner

PRINTER WITH IMPROVED PAPER DISPENSING MECHANISM

BACKGROUND OF THE INVENTION

1. Field of the Invention

The present invention relates to printer technology and more particularly, to a printer with improved paper dispensing mechanism so designed that the rollers of the paper dispensing roller set of the paper dispensing mechanism are made of a flexible and elastic material and pressed against each other and the distance between the center of the two rollers is less than the combination of the radius of the two rollers. Because the two rollers are squeezed to be clamped on the two opposite surfaces of the sheet of paper, when the user picks up the sheet of paper, the sheet of paper of the paper roll will not be pulled to move outward, avoiding tearing the sheet of paper of the paper roll or mechanical structure damage.

2. Description of the Related Art

With the development of technology, more and more products are coming out, making people's lives more convenient through these products. For example, with the development of automatic vending machines, automatic teller machines and other automatic processing machines, the work that would have been done manually can be done by a machine. With the help of machines, the business hours can be extended to 24 hours a day. In modern times, things change, and nightlife is rich, the use of automatic machines allow consumers to buy goods (such as: drinks, instant noodles, cigarettes, tickets, admission tickets, etc.) anytime and anywhere. Further, if the money carried is insufficient, you can also look for the automatic teller machine to withdraw cash, which can meet the convenience and speed that modern people pay attention to.

However, with the development of alternative currencies (such as credit cards, leisure cards, smart cards, etc.), and due to the drawback that carrying cash is inconvenient and vulnerable to theft or loss, people are gradually accustomed to using alternative currencies. Under this change in consumer behavior, more and more stores are available for consumption in alternative currencies and automatic processing machines are gradually adding devices that use alternative currencies.

The above automatic processing machine needs to print the relevant information to the user after the user completes the operation. For example, the consumer needs to print the receipt after purchasing, and after making the cash withdrawal or transfer, a detailed list needs to be printed. Therefore, the general automatic processing machine is equipped with a printing module. After the processing is completed, the relevant information is transmitted to the printing module for printing, and the printed sheet of paper is exposed to the paper exit for the user to pick up.

However, the paper of the general printing module is a continuous sheet of paper, and the paper is delivered to the paper exit when printing, so that the paper front end protrudes out of the paper exit when the paper has not been completely dispensed. Since the paper is moved by the rotation of rollers, if the user picks up the continuous sheet of paper before completion of the paper dispensing operation, the paper can be ripped or torn, and the user will be unable to read the required information on the paper, and the original intention of the paper to provide the user-related information will not be achieved. Further, excessively pulling the sheet of paper can easily cause the internal mechanical structure to be abnormally linked, and thus the mechanical structure can be subjected to external force to cause damage such as gear collapse, shaft deflection and the like.

Therefore, how to solve the above-mentioned drawbacks is the direction that the relevant industry players in this industry are eager to study and improve.

SUMMARY OF THE INVENTION

The present invention has been accomplished under the circumstances in view. It is therefore the main object of the present invention to provide a printer with improved paper dispensing mechanism, which facilitates dispensing a sheet of paper without causing paper tearing abnormality or mechanical structure damage.

To achieve this and other objects of the present invention, a printer in accordance with the present invention comprises a housing, a printing mechanism and a paper dispensing mechanism. The housing comprises a housing body with an accommodation chamber defined therein, a reel disposed between two inner rear side walls of the accommodation chamber to support a paper roll of a sheet of paper, a front panel located at a front side of the housing body and a paper exit formed in the front panel. The printing mechanism is positioned in the accommodation chamber, comprising a printing head for printing an ink on the sheet of paper of the paper roll, a paper cutter controlled to cut the sheet of paper of the paper roll, and a paper path defined between the printing head and the paper cutter for the passing of the leading end of the sheet of paper of the paper roll. The paper dispensing mechanism is positioned in the accommodation chamber, comprising a drive module and a paper dispensing roller set drivable by the drive module to carry the sheet of paper of the paper roll toward the paper exit. The paper dispensing roller set comprises two rollers made of a flexible and elastic material and pressed against each other. Further, the distance between the center of the two rollers is less than the combination of the radius of the two rollers. Because the two rollers are squeezed to be clamped on the two opposite surfaces of the sheet of paper, when the user picks up the sheet of paper, the sheet of paper of the paper roll will not be pulled to move outward, avoiding tearing the sheet of paper of the paper roll or mechanical structure damage.

DETAILED DESCRIPTION OF THE PREFERRED EMBODIMENT

Figure 1:
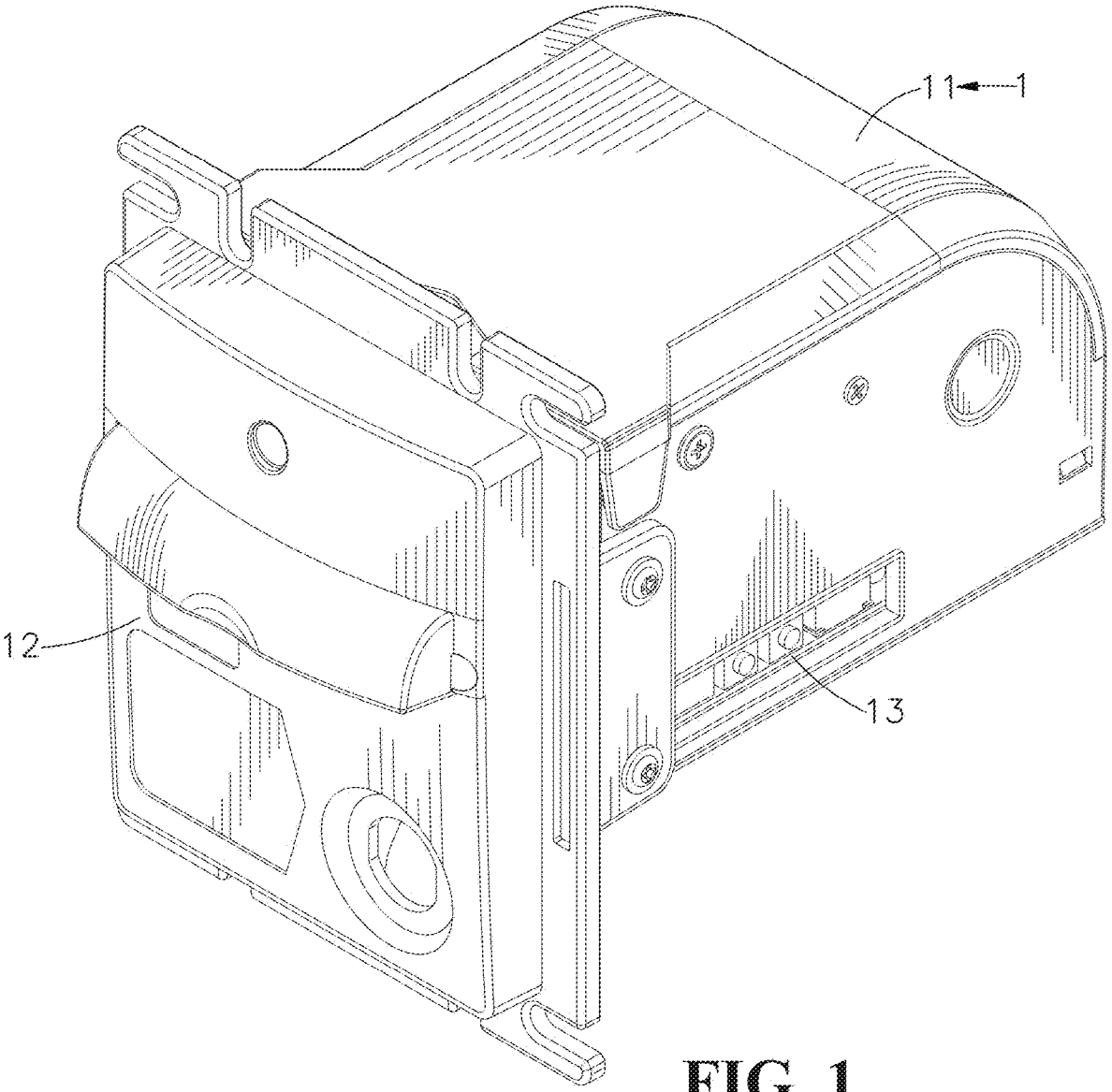
FIG. 1 is an elevational view of a printer with improved paper dispensing mechanism in accordance with the present invention.
Figure 2:
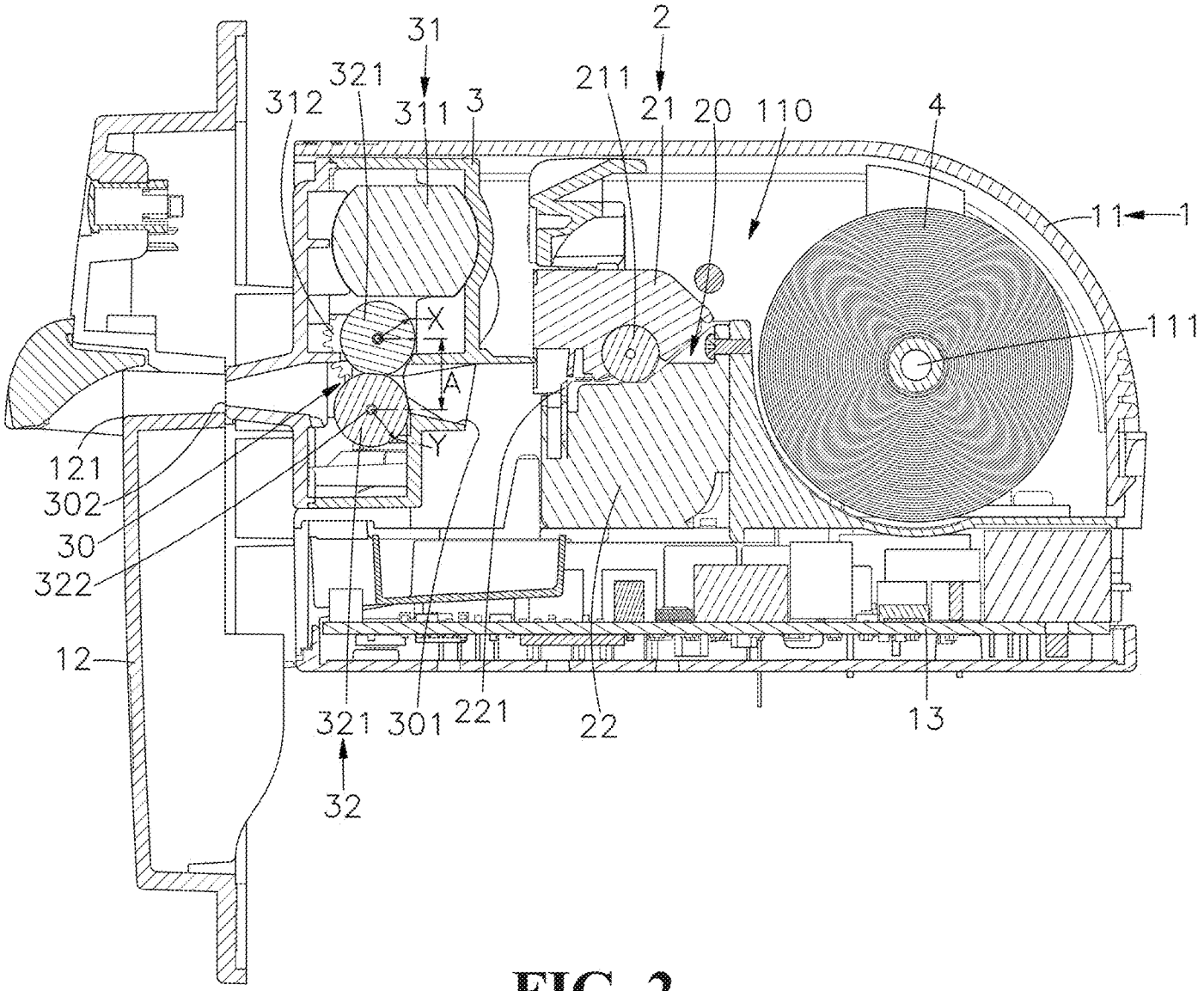
FIG. 2 is a sectional side view of the printer with improved paper dispensing mechanism in accordance with the present invention.
Figure 3:
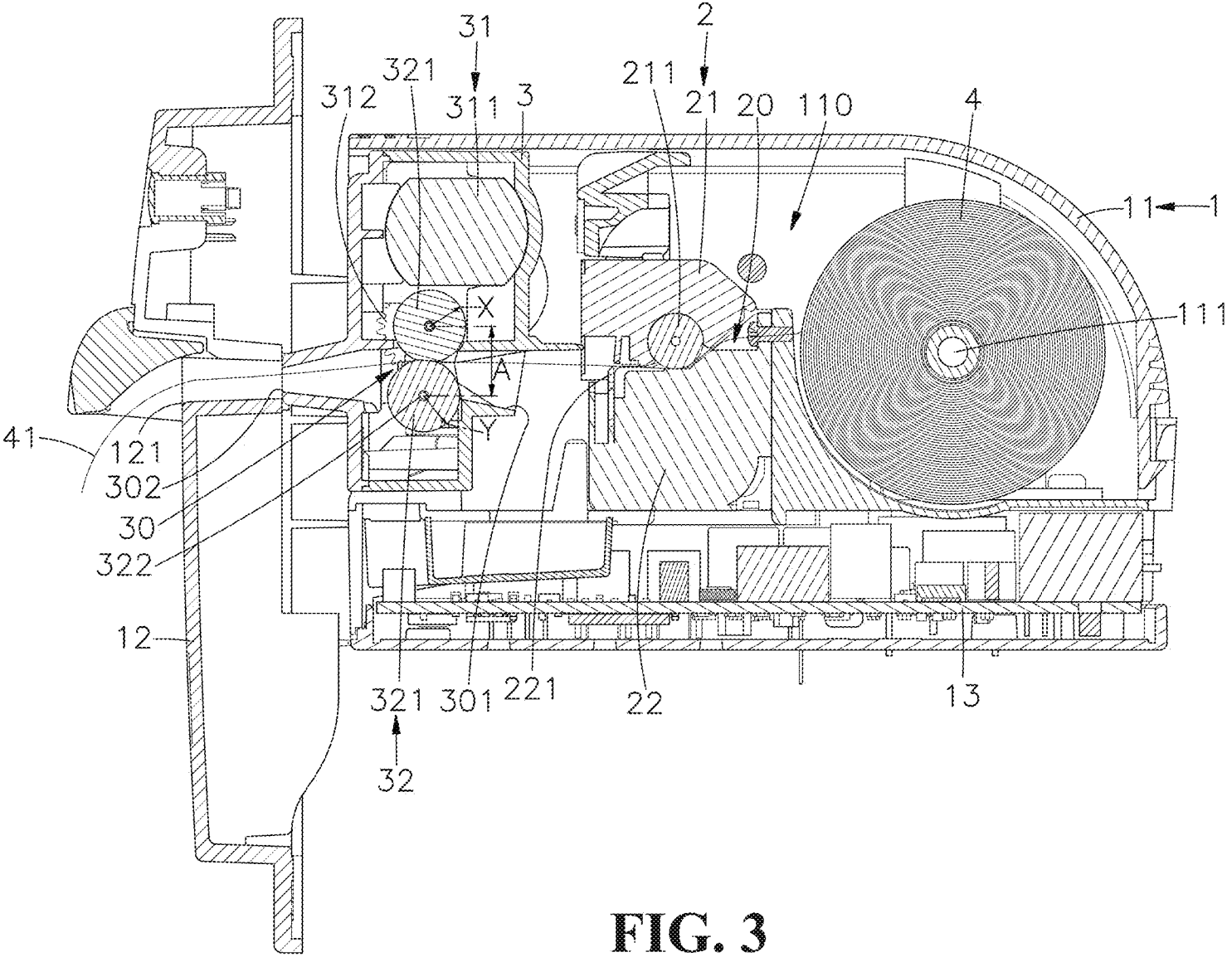
FIG. 3 is a schematic sectional side view of the present invention, showing the status of the internal structure of the printer before the cutting operation.
Figure 4:
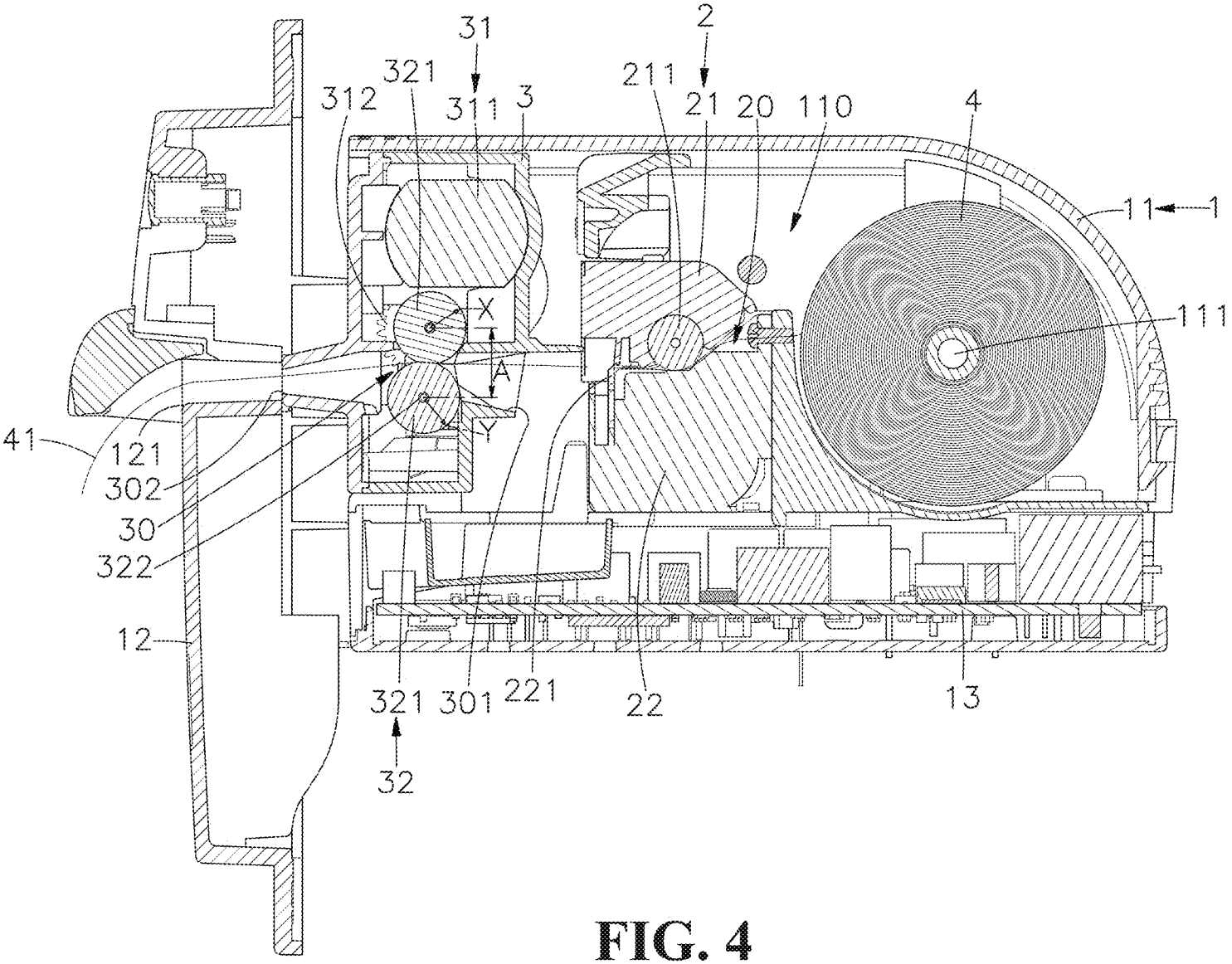
FIG. 4 is a schematic sectional side view of the present invention, showing the status of the internal structure of the printer after the cutting operation.

Referring to FIGS. 1-4, an elevational view, a side view, a schematic side view before cutting and a schematic side view after cutting of a printer with improved paper dispensing mechanism in accordance with the present invention are shown. As illustrated, the printer comprises a housing 1, a printing mechanism 2 and a paper dispensing mechanism 3.

The housing 1 comprises a housing body 11 with an accommodation chamber 110 defined therein, a reel 111 disposed between two opposite inner rear side walls of the accommodation chamber 110, a front panel 12 located at a front side of the housing body 11, a paper exit 121 formed in the front panel 12, and a circuit module 13 mounted on a bottom surface inside the accommodation chamber 110 of the housing body 11.

The printing mechanism 2 comprises a printing head 21 and a paper cutter 22 positioned opposite to each other in the accommodation chamber 110 and respectively electrically connected to the circuit module 13, and a paper path 20 defined between the printing head 21 and the paper cutter 22. The printing head 21 is provided with a printing wheel 211 adjacent to one lateral side of the paper path 20. The paper cutter 22 is provided with a cutter blade 221 adjacent to an opposite lateral side of the paper path 20.

The paper dispensing mechanism 3 is positioned in the accommodation chamber 110, comprising a drive module 31 electrically connected to the circuit module 13, which comprises a motor 311 and a plurality of gears 312 coupled to the motor 311, and a paper dispensing roller set 32 disposed in front of the printing mechanism 2 and driven to rotate by the drive module 31. The paper dispensing roller set 32 comprises two rollers 321 which are made of a flexible and elastic material and are pressed against each other. The distance between the center of the two rollers 321 is less than the combination of the radius of the two rollers 321 (i.e., $A<X+Y$). Further, a roller shaft 322 is disposed inside each roller 321, and at least one roller shaft 322 is coupled to the gears 312. Further, a paper-dispensing paper path 30 is defined between the two rollers 321 and disposed in communication with the paper path 20 of the printing mechanism 2. The paper-dispensing paper path 30 has an inlet 301 defined in a rear end thereof and connected to the paper path 20 of the printing mechanism 2, and an outlet 302 defined in an opposing front end thereof and connected to the paper exit 121 of the front panel 12.

In the present preferred embodiment, the printing head 21 of the printing mechanism 2 uses the printing wheel 211 to perform printing operation. However, in practical applications, it is also possible to use dot matrix, hot pressing, ink jet or other printing methods. However, there are many printing methods for the printing head 21, so that any structure that can achieve the aforementioned effects should be covered by the present invention. Simple modifications and equivalent structural changes shall be included in the scope of the present invention.

Moreover, how the printing head 21 and the paper cutter 22 of the printing mechanism 2 perform the printing operation and the cutting operation are the conventional techniques, and the printing mechanism 2 has many devices and components and is not the focus of the invention of the present invention, so it will not be described.

Furthermore, the two rollers 321 of the paper dispensing roller set 32 can be made of a flexible and elastic material such as rubber, silicone rubber or plastic.

When the invention is actually used, it can be applied to a game machine, a lottery machine, a parking ticket machine or other types of machines that need to print paper and tickets, and the circuit module 13 of the housing 1 is used to electrically connect with the circuit board in the machine (not shown). In application, a paper roll 4 is mounted on the reel 111 in the accommodation chamber 110 of the housing body 11 of the housing 1, and the leading end of a sheet of paper 41 of the paper roll 4 is inserted into a side of the paper path 20 of the printing mechanism 2.

In operation, the printing head 21 of the printing mechanism 2 prints the ink on the surface of the sheet of paper 41 of the paper roll 4 through the printing wheel 211. At the same time, the sheet of paper 41 is conveyed toward the other side of the paper path 20, so that the sheet of paper 41 enters from the inlet 301 into the paper-dispensing paper path 30 of the paper dispensing mechanism 3, and is inserted in between the two rollers 321 of the paper dispensing roller set 32. At the same time, the drive module 31 of the paper dispensing mechanism 3 drives the motor 311 to rotate the gears 312, causing rotation of the roller shafts 322 of the paper dispensing roller set 32, and thus, the two rollers 321 are rotated and clamped on the two opposite surfaces of the sheet of paper 41. After the printing mechanism 2 printed the surface of the sheet of paper 41, the paper cutter 22 of the printing mechanism 2 is driven to cut the sheet of paper 41 by the cutter blade 221, and the sheet of paper 41 been cut is then delivered by the rollers 321 to the outlet 302 of the paper-dispensing paper path 30 toward the paper exit 121 on the front panel 12 so that the user outside the machine can pick up the cut part of the sheet of paper 41. Because the two rollers 321 are made of a flexible and elastic material and the distance between the center of the two rollers 321 is less than the combination of the radius of the two rollers 321, the two rollers 321 are squeezed to be clamped on the two opposite surfaces of the sheet of paper 41. Thus, when the user picks up the sheet of paper 41, the sheet of paper 41 of the paper roll 4 will not be pulled to move outward, avoiding tearing the sheet of paper 41 of the paper roll 4 or pulling too much of the sheet of paper 41 of the paper roll 4. Therefore, the invention can save the sheet of paper, reduce the cost, and avoid abnormal linking of the mechanical structure, thereby preventing gear damage and shaft deflection of the mechanical structure.

It is to be understood that the above-described preferred embodiment of the invention is merely a possible example of implementations, merely set forth for a clear understanding of the principles of the invention, many modifications and enhancements may be made without departing from the spirit and scope of the invention. Accordingly, the invention is not to be limited except as by the appended claims.

The invention claimed is:

1. A printer, comprising:

a housing comprising:

a housing body with an accommodation chamber defined therein;

a reel disposed between two inner rear side walls of said accommodation chamber to support a paper roll of a sheet of paper;

a front panel located at a front side of said housing body;

a paper exit formed in said front panel; and a circuit module on a bottom surface inside said accommodation chamber of said housing body;

a printing mechanism positioned in said accommodation chamber, said printing mechanism comprising a printing head for printing an ink on said sheet of paper of said paper roll, a paper cutter, and a paper path defined between said printing head and said paper cutter for the passing of a leading end of said sheet of paper of said paper roll; and a paper dispensing mechanism positioned in said accommodation chamber, said paper dispensing mechanism comprising a drive module and a paper dispensing roller set drivable by said drive module to carry said sheet of paper of said paper roll toward said paper exit, said paper dispensing roller set comprising two rollers made of a flexible and elastic material and pressed against each other, the distance between a center of said two rollers being less than a combination of a radius of said two rollers, wherein the paper dispensing mechanism is located adjacent to the paper exit formed in the front panel, wherein the circuit module is electrically connected with said printing head, said paper cutter and said drive module.

2. The printer as claimed in claim 1, wherein said printing head of said printing mechanism comprises a printing wheel disposed adjacent to one lateral side of said paper path for printing an ink on a surface of said sheet of paper of said paper roll; said paper cutter comprises a cutter blade disposed adjacent to an opposite lateral side of said paper path for cutting said sheet of paper of said paper roll.

3. The printer as claimed in claim 1, wherein said drive module of said paper dispensing mechanism comprises a motor, and a plurality of gears coupled to and drivable by said motor; said two rollers of said paper dispensing roller set each comprise a roller shaft coupled to said gears of said paper dispensing mechanism.

4. The printer as claimed in claim 1, wherein said two rollers of said paper dispensing roller set define therebetween a paper-dispensing paper path in communication with said paper path of said printing mechanism for the passing of said sheet of paper of said paper roll, said paper-dispensing paper path having an inlet defined in a rear end thereof and connected to said paper path of said printing mechanism and an outlet defined in an opposing front end thereof and connected to said paper exit of said front panel.

5. The printer as claimed in claim 1, wherein said flexible and elastic material of said two rollers of said paper dispensing roller set is selected from the group of rubber, silicone rubber and plastic.

* * * * *